US006695057B2

(12) United States Patent
Ingram et al.

(10) Patent No.: US 6,695,057 B2
(45) Date of Patent: Feb. 24, 2004

(54) FRACTURING PORT COLLAR FOR WELLBORE PACK-OFF SYSTEM, AND METHOD FOR USING SAME

(75) Inventors: Gary D. Ingram, Richmond, TX (US); Corey E. Hoffman, Magnolia, TX (US); Richard L. Giroux, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/073,685

(22) Filed: Feb. 11, 2002

(65) Prior Publication Data

US 2002/0195248 A1 Dec. 26, 2002

Related U.S. Application Data

(63) Continuation-in-part of application No. 09/858,153, filed on May 15, 2001, now abandoned.

(51) Int. Cl.[7] ..... E21B 43/25
(52) U.S. Cl. ..... 166/308; 166/185
(58) Field of Search ..... 166/308, 305.1, 166/373, 374, 106, 147, 185

(56) References Cited

U.S. PATENT DOCUMENTS

| | | | |
|---|---|---|---|
| 1,721,004 A | 7/1929 | Debose | |
| 2,177,601 A | 10/1939 | Smith et al. | 166/10 |
| 3,035,639 A | 5/1962 | Brown et al. | 166/150 |

(List continued on next page.)

FOREIGN PATENT DOCUMENTS

| | | | |
|---|---|---|---|
| GB | 2 275 284 | 8/1994 | E21B/17/10 |
| GB | 2 292 400 | 2/1996 | E21B/33/1295 |
| WO | WO 01/94743 | 12/2001 | E21B/34/14 |

OTHER PUBLICATIONS

PCT International Search Report, International Application No. PCT/GB 03/00509, dated Jul. 9, 2003.

Flow Control Equipment Tubing Pack–Off, Baker Section VI, Composite Catalog of Oil Field Equipment & Services, 31st Revision 1974–75, vol. 1, 1974, pp. 446, 447.

(List continued on next page.)

*Primary Examiner*—Frank Tsay
(74) *Attorney, Agent, or Firm*—Moser, Patterson & Sheridan, L.L.P.

(57) ABSTRACT

A collar for injecting fluid, such as a formation treating fluid, into a wellbore, and a method for using same. The collar is disposed between the upper and lower packing elements of a pack-off system during the treatment of an area of interest within a wellbore. The collar first comprises an inner mandrel running essentially the length of the collar. The inner bore of the collar is in fluid communication with the annular region between the collar and the surrounding perforated casing by a set of actuation ports. A second set of ports, known as frac ports, is disposed within the mandrel. In accordance with one aspect of the invention, the collar further comprises a tubular case which substantially seals the frac ports in a first position, and slidably moves along the outer surface of the mandrel in order to expose the frac ports in a second position. In operation, the upper and lower packing elements are set at a first fluid pressure level. Upon application of a second greater fluid pressure level, the upper and lower packing elements are further separated in accordance with a designed stroke length, thereby exposing the frac ports.

56 Claims, 5 Drawing Sheets

U.S. PATENT DOCUMENTS

| | | | | | |
|---|---|---|---|---|---|
| 3,044,553 | A | | 7/1962 | Bradley | 166/187 |
| 3,270,814 | A | | 9/1966 | Richardson et al. | 166/21 |
| 3,436,084 | A | | 4/1969 | Courter | 277/116.2 |
| 3,437,142 | A | | 4/1969 | Conover | 166/277 |
| 3,503,249 | A | | 3/1970 | Dumond | 73/49.1 |
| 3,542,127 | A | | 11/1970 | Malone | 166/122 |
| 3,749,166 | A | | 7/1973 | Young | 166/123 |
| 3,797,572 | A | | 3/1974 | Mignotte | 166/127 |
| 3,861,465 | A | * | 1/1975 | Mignotte | 166/255.1 |
| 3,876,000 | A | | 4/1975 | Nutter | 166/106 |
| 3,876,003 | A | | 4/1975 | Kisling | |
| 3,913,675 | A | * | 10/1975 | Smyrl | 166/278 |
| 4,216,827 | A | | 8/1980 | Crowe | 166/120 |
| 4,224,987 | A | | 9/1980 | Allen | 166/120 |
| 4,279,306 | A | | 7/1981 | Weitz | 166/312 |
| 4,421,135 | A | | 12/1983 | Harshman et al. | 137/312 |
| 4,421,165 | A | | 12/1983 | Szarka | 166/151 |
| 4,458,876 | A | | 7/1984 | Schaeper et al. | 251/1 B |
| 4,482,086 | A | | 11/1984 | Wagner et al. | 277/12 |
| 4,485,876 | A | | 12/1984 | Speller | 166/373 |
| 4,492,383 | A | | 1/1985 | Wood | 277/34 |
| 4,499,947 | A | | 2/1985 | Zsoka et al. | 166/179 |
| 4,519,451 | A | * | 5/1985 | Gray et al. | 166/278 |
| 4,519,456 | A | | 5/1985 | Cochran | 166/312 |
| 4,569,306 | A | | 2/1986 | Ito et al. | 118/249 |
| 4,569,396 | A | | 2/1986 | Brisco | 166/305.1 |
| 4,722,400 | A | * | 2/1988 | Burns | 166/330 |
| 4,840,231 | A | | 6/1989 | Berzin et al. | 166/387 |
| 4,869,324 | A | | 9/1989 | Holder | 166/387 |
| 4,934,460 | A | | 6/1990 | Coronado | 166/386 |
| 5,000,265 | A | | 3/1991 | Pleasants et al. | 166/387 |
| 5,033,558 | A | | 7/1991 | Russo et al. | 175/325 |
| 5,044,444 | A | | 9/1991 | Coronado | 166/387 |
| 5,046,557 | A | | 9/1991 | Manderscheid | 166/120 |
| 5,146,994 | A | | 9/1992 | Pleasants et al. | 166/387 |
| 5,443,124 | A | | 8/1995 | Wood et al. | 166/374 |
| 5,803,178 | A | | 9/1998 | Cain | 166/306 |
| 5,988,285 | A | | 11/1999 | Tucker et al. | 166/373 |
| 5,992,524 | A | | 11/1999 | Graham | 166/313 |
| 6,105,670 | A | * | 8/2000 | Klos et al. | 166/265 |
| 6,253,856 | B1 | | 7/2001 | Ingram et al. | 166/374 |

OTHER PUBLICATIONS

Otis Completion Systems and Service People . . . , Otis Well Completions, Composite Catalog of Oil Field Equipment & Services, 36$^{th}$ Revision 1984–85, vol. 4, 1984, p. 6232.

Otis Wireline Production Equipment, Otis Pack–Off Anchors, Composite Catalog of Oil Field Equipment & Services, 31$^{st}$ Revision 1974–75, vol. 1, 1974, p. 3973.

Jani International Inc. 1987–1988 Catalogue, pp. 75,76,82, and 84.

Baker Packers 1984–85 Catalog, Flow Control Systems, pp. 608–611.

Journal of Petroleum Technology, Production Technology Reservior Asset Management Bit Technology, TAM, Dec. 2001, p. 27.

Journal of Petroleum Technology, Field Revitalization Well Control Tertiary Recovery, Jet Pack, Jan. 2002, p. 5.

Journal of Petroleum Technology, Drilling Technology Well Testing Reservoir Revitalization, Jet Pack, Feb. 2002, p. 5.

Martinez, S.J., et al., Formation Fracturing, Petroleum Engineering Handbook, Chapter 55, pp. 55–1–55–10.

* cited by examiner

FRACTURING PORT COLLAR FOR WELLBORE PACK-OFF SYSTEM, AND METHOD FOR USING SAME

RELATED APPLICATIONS

This application is a continuation-in-part of a divisional application entitled "PACK-OFF SYSTEM." The divisional application was filed on May 15, 2001, and has U.S. Ser. No. 09/858,153, now abandoned. The divisional application is incorporated herein in its entirety, by reference.

The divisional application derives priority from a parent application having U.S. Ser. No. 09/435,388, filed Nov. 6, 1999. That application was also entitled "PACK-OFF SYSTEM," and issued on Jul. 3, 2001 as U.S. Pat. No. 6,253,856. The parent '856 patent is also incorporated herein in its entirety, by reference.

BACKGROUND OF THE INVENTION

1. Field of the Invention

This invention is related to downhole tools for a hydrocarbon wellbore. More particularly, the invention relates to an apparatus useful in conducting a fracturing or other wellbore treating operation. More particularly still, this invention relates to a collar having valves through which a wellbore treating fluid such as a "frac" fluid may be pumped, and a method for using same.

2. Description of the Related Art

In the drilling of oil and gas wells, a wellbore is formed using a drill bit that is urged downwardly at a lower end of a drill string. When the well is drilled to a first designated depth, a first string of casing is run into the wellbore. The first string of casing is hung from the surface, and then cement is circulated into the annulus behind the casing. Typically, the well is drilled to a second designated depth after the first string of casing is set in the wellbore. A second string of casing, or liner, is run into the wellbore to the second designated depth. This process may be repeated with additional liner strings until the well has been drilled to total depth. In this manner, wells are typically formed with two or more strings of casing having an ever-decreasing diameter.

After a well has been drilled, it is desirable to provide a flow path for hydrocarbons from the surrounding formation into the newly formed wellbore. Therefore, after all casing has been set, perforations are shot through the liner string at a depth which equates to the anticipated depth of hydrocarbons. Alternatively, a liner having pre-formed slots may be run into the hole as casing. Alternatively still, a lower portion of the wellbore may remain uncased so that the formation and fluids residing therein remain exposed to the wellbore.

In many instances, either before or after production has begun, it is desirable to inject a treating fluid into the surrounding formation at particular depths. Such a depth is sometimes referred to as "an area of interest" in a formation. Various treating fluids are known, such as acids, polymers, and fracturing fluids.

In order to treat an area of interest, it is desirable to "straddle" the area of interest within the wellbore. This is typically done by "packing off" the wellbore above and below the area of interest. To accomplish this, a first packer having a packing element is set above the area of interest, and a second packer also having a packing element is set below the area of interest. Treating fluids can then be injected under pressure into the formation between the two set packers.

A variety of pack-off tools are available which include two selectively-settable and spaced-apart packing elements. Several such prior art tools use a piston or pistons movable in response to hydraulic pressure in order to actuate the setting apparatus for the packing elements. However, debris or other material can block or clog the piston apparatus, inhibiting or preventing setting of the packing elements. Such debris can also prevent the un-setting or release of the packing elements. This is particularly true during fracturing operations, or "frac jobs," which utilize sand or granular aggregate as part of the formation treatment fluid.

In addition, many known prior art pack-off systems require the application of tension and/or compression in order to actuate the packing elements. Such systems cannot be used on coiled tubing.

There is, therefore, a need for an efficient and effective wellbore straddle pack-off system which does not require mechanical pulling and/or pushing in order to actuate the packing elements. Further, is a need for such a system which does not require a piston susceptible to becoming clogged by sand or other debris. Further, there is a need for a pack-off system capable of being operated on coiled tubing.

In the original parent application entitled "PACK-OFF SYSTEM," a straddle pack-off system was disclosed which addresses these shortcomings. U.S. Pat. No. 6,253,856 B1 (the "856 parent patent") is again referred to and incorporated in its entirety herein, by reference. The pack-off systems in the '856 parent patent have advantageous ability in the context of acidizing or polymer treating operations. However, there is concern that the ports 47 of the pack-off system (such as in FIGS. 1 and 2) may become clogged with sand during a frac job. Therefore, a need further exists for a straddle pack-off system having a specialized collar using larger ports which are opened after the packing elements 40, 41 of the pack-off system have been actuated and set in the wellbore.

Finally, a need exists for a collar within a pack-off system having larger ports to accommodate a greater volume of treating fluid after the packing elements are set.

SUMMARY OF THE INVENTION

The present invention discloses a novel collar, and a method for using a fracturing port collar. The fracturing port collar is designed to be used as part of a pack-off system during the treatment of an area of interest within a wellbore. The pack-off system is run into a wellbore on a tubular working string, such as coiled tubing. The pack-off system is designed to sealingly isolate an area of interest within a wellbore. To this end, the pack-off system utilizes an upper and a lower packing element, with at least one port being disposed between the upper and lower packing elements to permit a wellbore treating fluid to be injected therethrough. Exemplary pack-off systems are disclosed in the '856 parent patent.

The packing elements may be inflatable, they may be mechanically set, or they may be set with the aid of hydraulic pressure. In the arrangements shown in the parent '856 patent, the packing elements are set through a combination of mechanical and hydraulic pressure. In these arrangements, a flow restriction is provided at the lower end of the pack-off system. A setting fluid, such as water or such as the treating fluid itself, is placed into the pack-off system under pressure. The flow restriction causes a pressure differential to build within the tool, ultimately causing flow through the bottom of the pack-off system to cease, and forcing fluid to flow through the ports intermediate to the upper and lower packing elements. This differential pressure also causes the packing elements themselves to set.

After the packing elements have been set, a treating fluid is injected under pressure through the ports and into the surrounding wellbore. Various treating fluids may be used, including acids, polymers, and fracturing gels. The packing elements are then unset by relieving the applied fluid pressure, such as through use of an unloader. The pack-off system may then be moved to a different depth within the wellbore in order to treat a subsequent zone of interest. Alternatively, the pack-off system may be pulled from the wellbore. To this end, the packing elements are not permanently set within the wellbore, but remain attached to the working string.

The present invention introduces a novel fluid placement port collar into a pack-off system. In accordance with the present invention, the collar is disposed between the upper and lower packing elements. Where a spacer pipe is also used between the packing elements, the collar is preferably placed below the spacer pipe, such as the spacer tube 46 shown in FIG. 1B of the '856 parent patent.

The collar first comprises an inner mandrel. The mandrel defines an essentially tubular body having a top end and a bottom end within the collar. One or more packer actuation ports are disposed within the pack-off system intermediate the upper and lower packing elements. Preferably, the actuation ports are placed within the mandrel itself intermediate the top and bottom ends. The purpose of the actuation ports is to place the inner bore of the pack-off system in fluid communication with the annular region defined between the outside of the pack-off system and the surrounding casing (or formation).

In the '856 parent patent, the packer actuation ports are represented by port 47 in FIG. 1B. The actuation ports are of a restricted diameter in order to limit the flow of fluid into the annular region between the pack-off tool and the surrounding formation. This aids in the setting of the packing elements. Setting of the packing elements is accomplished at a first pressure level.

The collar of the present invention further comprises a set of ports disposed in the wall of the tubular mandrel. In one aspect of the present methods, the wall ports define fracturing ports, or "frac ports." The frac ports are of a larger diameter than the actuation ports in order to permit a greater volume of formation treating fluid to flow through the mandrel and into the formation. In the case of a fracturing operation, the larger frac ports are configured so that they will not become clogged by the aggregate contents of the fracturing fluid. The frac ports are disposed intermediate the top and bottom ends of the inner mandrel, and are placed immediately above or below the actuation ports.

In accordance with the present invention, the frac ports are not exposed to the annulus between the pack-off system and the formation when the packing elements are initially set; instead, they are sealed by a surrounding tubular called a "case." Once the packing elements are set, fluid continues to be injected into the wellbore until a second greater pressure level is achieved. In this respect, the tubular case of the fluid placement port collar is movable in response to changes in fluid flow rate. In one arrangement, fluid placement port collar is configured so that the case is able to slide axially relative to the outer surface of the inner mandrel. In this respect, the collar is capable of telescopically extending along a designed stroke length. As pressure builds between the packing elements, the packing elements separate in accordance with the stroke length designed within the collar. The frac ports of the collar are ultimately cleared of the case and are exposed to the surrounding perforated casing. Formation fracturing fluid can then be injected into the formation without fear of the ports becoming clogged.

DESCRIPTION OF THE DRAWINGS

A more particular description of embodiments of the invention summarized above may be had by references to the embodiment which are shown in the drawings below, which form a part of this specification. These drawings illustrate certain preferred embodiments and are not to be used to limit the scope of the inventions, which may have other equally effective and equivalent embodiments.

FIGS. 1B–1C include the portion which includes the frac port collar of the present invention.

DETAILED DESCRIPTION

Figure 1:
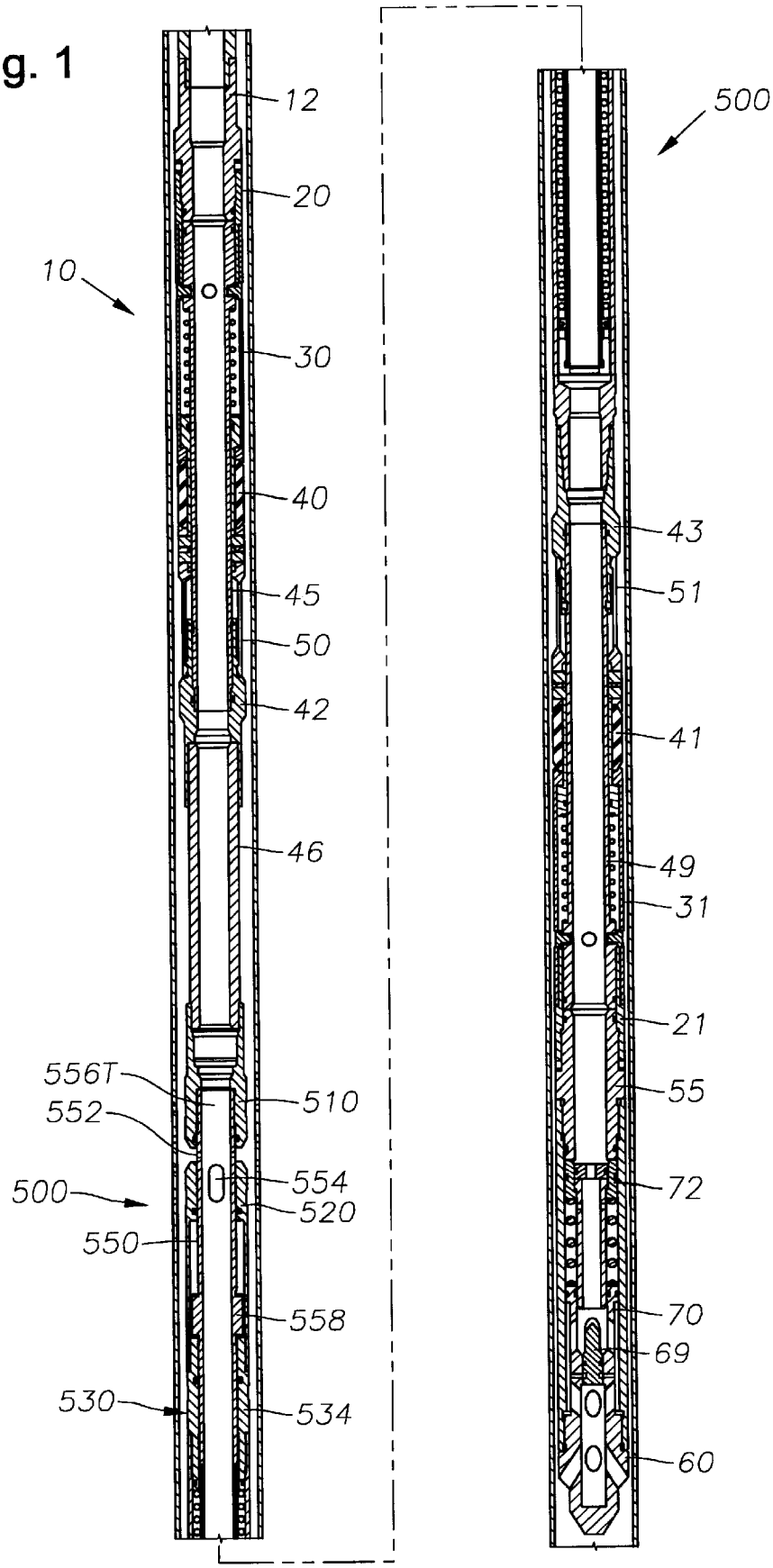
FIG. 1 is a cross-sectional view of a pack-off system as might be used with a collar of the present invention, in a "run-in" configuration. Visible in this view is a novel frac port collar, in cross-section.

FIG. 1 presents a sectional view of a straddle pack-off system as might be used with a fracturing port collar 500 of the present invention. The system 10 is seen a "run-in" configuration. FIGS. 1A, 1B, 1C and 1D present the system 10 of FIG. 1 in separate enlarged portions. The system 10 operates to isolate an area of interest within a wellbore, as shown in FIG. 2. The system 10 is run into the wellbore on a working string S. The working string S is shown schematically in FIG. 1A. The working string S is any suitable tubular useful for running tools into a wellbore, including but not limited to jointed tubing, coiled tubing, and drill pipe.

The system 10 first comprises a top packing element 40 and a bottom packing element 41. The packing elements 40, 41 may be made of any suitable resilient material, including but not limited to any suitable elastomeric or polymeric material. Actuation of the top 40 and bottom 41 packing elements below the working string S is accomplished, in one aspect, through the combined application of mechanical and hydraulic pressure, as disclosed in the '856 parent patent.

Figure 1A:
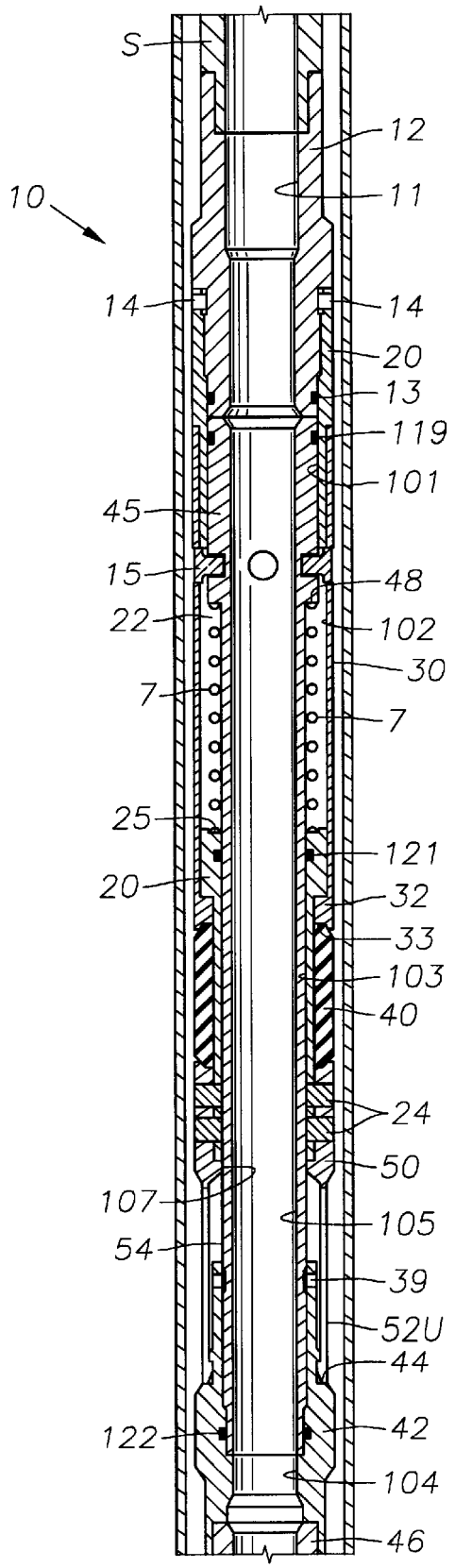
FIGS. 1A, 1B, 1C and 1D present enlargements of portions of the pack-off system of FIG. 1.
Figure 2:
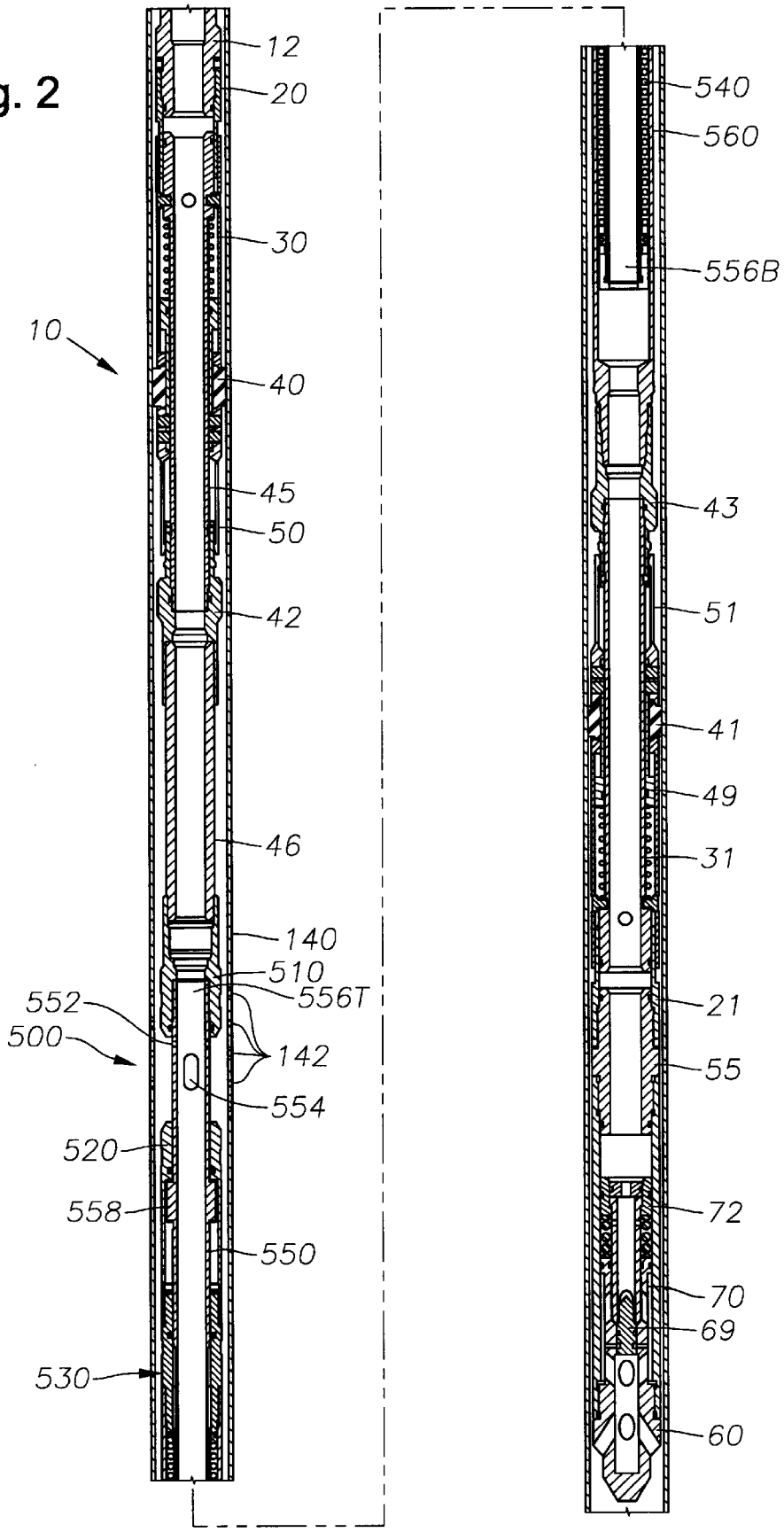
FIG. 2 shows the pack-off system of FIG. 1, with the packing elements set in a string of casing.

Visible at the top of the pack-off system 10 in FIG. 1A is a top sub 12. The top sub 12 is a generally cylindrical body having a flow bore 11 therethrough. The top sub 12 is threadedly connected at a top end to the working string S. It is understood that additional tools, such as an unloader (not shown) may be used with the pack-off system 10 on the working string S.

At a lower end, the top sub 12 is threadedly connected to a top-pack off mandrel 20. The top pack-off mandrel 20 defines a tubular body surrounding a lower portion of the top sub 12. An o-ring 13 seals a top sub 12/mandrel 20 interface. Set screws 14 optionally prevent unthreading of the top pack-off mandrel 20 from the top sub 12.

The portion of the pack-off system 10 shown in FIG. 1A also includes a top setting sleeve 30 and a top body 45. The setting sleeve 30 and the top body 45 each generally define a cylindrical body. The upper end of the top body 45 is nested within the top pack-off mandrel 20. The top setting sleeve 30 and the top body 45 are secured together through one or more crossover pins 15. The pins 15 extend through slots 22 in the top pack-off mandrel 20 so that the setting sleeve 30 and the top body 45 are moveable together with respect to the top pack-off mandrel 20 while the pins 15 are in the slots 22. In this respect, the slots 22 define recesses longitudinally machined into the top pack-off mandrel 20 to permit the setting sleeve 30 and the top body 45 to slide downward along the inner and outer surfaces of the top pack-off mandrel 20, respectively.

The top body 45 includes a shoulder 48. Likewise, the top pack-off mandrel 20 includes a shoulder 25. The shoulder 25 of the top pack-off mandrel 20 is opposite the shoulder 48 of the top body 45. The top pack-off mandrel 20, the top body 45, and the shoulders 25 and 48 define a chamber region which houses a top spring 7 held in compression. Initially, the top spring 7 urges the top body 45 upward towards the top sub 12. This maintains a top latch 50 (described below) in a latched position with an upper bottom sub 42, thereby preventing the premature setting of the top packing element 40.

The top setting sleeve 30 has an end 32 with a lip 33. The end 32 abuts a top end of the top packing element 40. The top packing element 40 is seen in FIG. 1A around a lower end of the top pack-off mandrel 20. The lip 33 of the top setting sleeve aids in forcing the extrusion of the top packing element 40 outwardly into contact with the surrounding casing (not shown) when the top packing element 40 is set.

The top latch 50 has a top end secured to a lower end of the top pack-off mandrel 20. Pins 24 are shown securing the top latch 50 to the top pack-off mandrel 20. The top latch 50 has a plurality of spaced-apart collet fingers 52U that initially latch onto a shoulder 44 of the upper bottom sub 42. Set screws 39 are used to secure the upper bottom sub 42 to a lower end of the top body 45. The top end of the upper bottom sub 42 is also threadedly connected to the lower end of the top body 45. In this way, the upper bottom sub 42 moves together with the top body 45 within the pack-off system 10. An o-ring 122 seals a top body/bottom sub interface.

Items 20, 30, 40, 42, 45 and 50 are generally cylindrical in shape. Each has a top-to-bottom bore 101, 102, 103, 104, 106, and 107, respectively, therethrough.

Figure 1B:
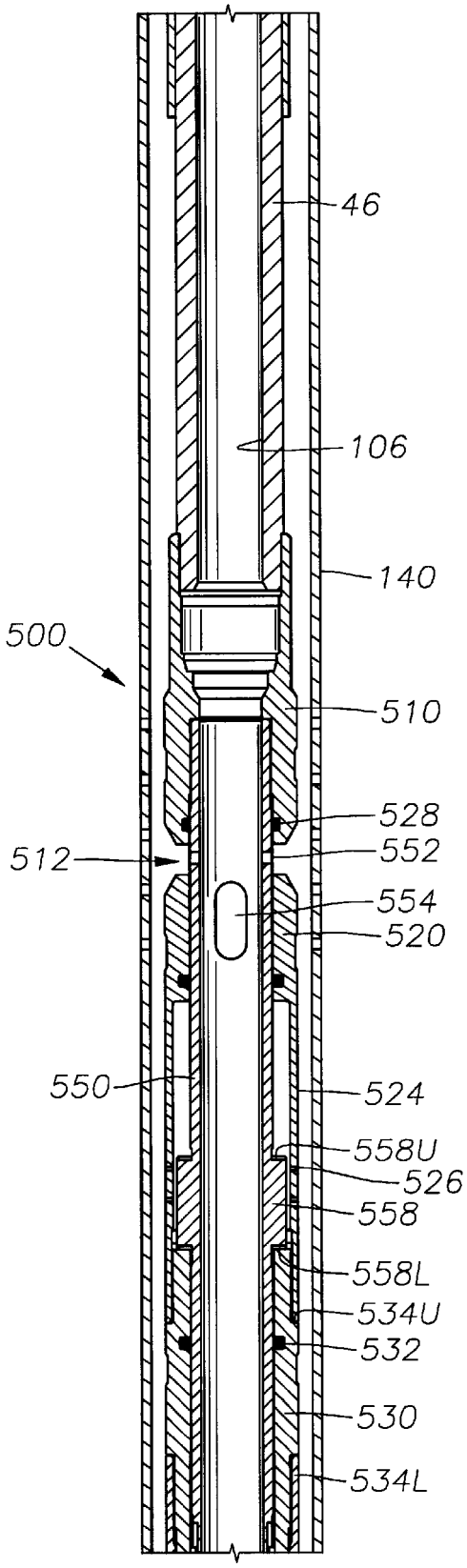
Figure 1C:
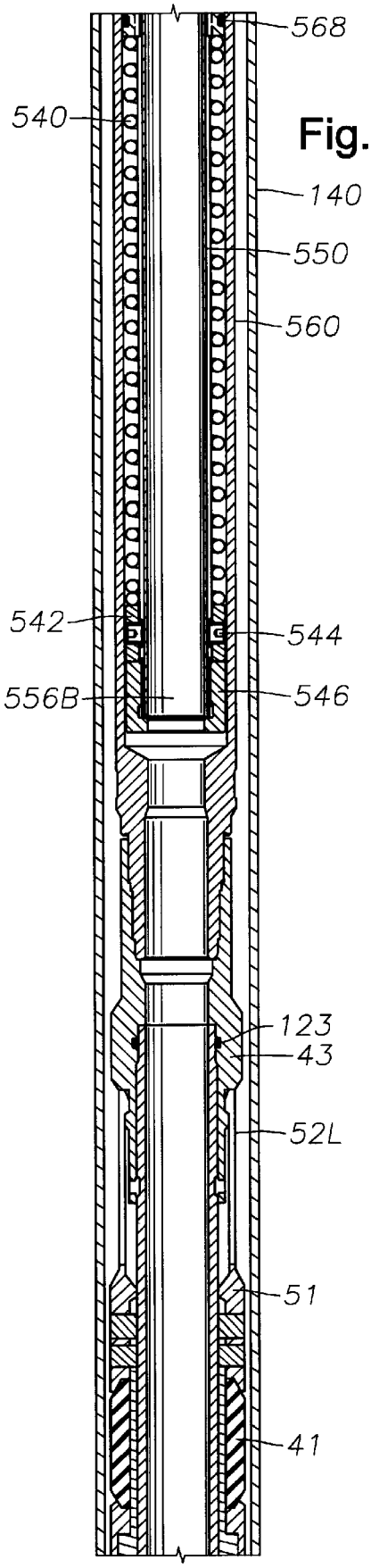
Figure 1D:
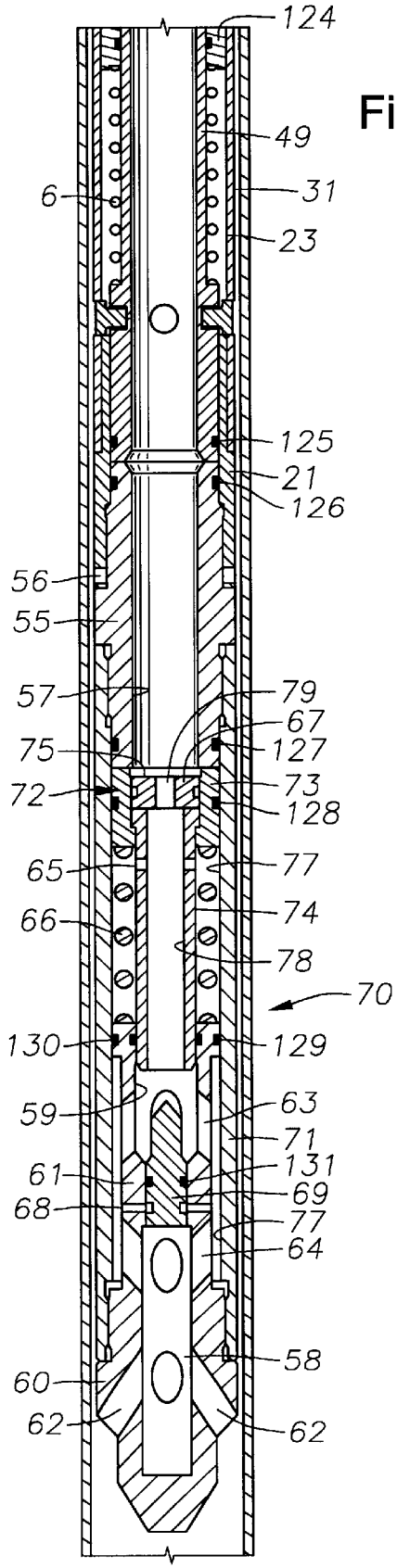

Various parts numbered between 20 and 52U have been defined and described above. These parts are disposed within the straddle pack-off system 10 at and above the upper bottom sub 42. The pack-off system 10 also includes a reciprocal set of parts. In this respect, various parts numbered between 52L and 21 define a reciprocal set of parts as seen in FIGS. 1C–1D. The following parts correspond to each other: 6–7; 20–21; 22–23; 30–31; 40–41; 42–43; 45–49; 50–51 and 52U–52L. In the arrangement of FIGS. 1 and 2, parts 20 to 52U operate to actuate the upper sealing element 40, while parts 52L to 21 operate to actuate the lower sealing element 41. In this arrangement, the parts 52L to 21 that actuate the lower sealing element 41 are a mirror of the parts 20 to 52U which actuate the upper sealing element 40. Thus, for example, the top pack-off mandrel 20 is above the top packing element 40, while the bottom pack-off mandrel 21 is below the lower packing element 41.

Various o-rings are used in order to seal interfaces within the straddle pack-off system 10. The following numerals seal the indicated interfaces: Seal 119 seals a mandrel 20/top body 45 interface at the upper end of the pack-off system 10, while seal 121 seals a pack-off mandrel 20/top body 45 interface below the biasing spring 7. Other seals are as follows: 122, upper bottom sub 42/top body 45; 123, bottom sub 43/bottom body 49; 124, bottom pack-off mandrel 21/bottom body 49; 125, bottom body 49/bottom pack-off mandrel 21; 126, crossover sub 55/bottom pack-off mandrel 21; and 127, crossover sub 55/valve housing 71.

A lower end of the bottom pack-off mandrel 21 is threadedly connected to an upper end of a crossover sub 55. Set screws 56 are used to secure the bottom pack-off mandrel 21 to the crossover sub 55. As shown in FIG. 1D, the crossover sub 55 has a top-to-bottom bore 57 therethrough. The crossover sub 55 is used to connect the portion of the pack-off system 10 employing the sealing elements 40, 41 (shown in FIGS. 1A and 1C, respectively) with a shut-off valve assembly 70 seen in FIG. 1D, and (discussed below)

The pack-off system 10 shown in FIGS. 1 and 2 includes an optional spacer pipe 46. The spacer pipe 46 joins the upper packing element 40 and associated parts (20–52U) to the lower packing element and its associated parts (52L–21). The spacer pipe 46 is seen in the enlarged view of FIG. 1B. The spacer pipe 46 has a top end which is threadedly connected to a lower end of the upper bottom sub 42. The length of the spacer pipe 46 is selected by the operator generally in accordance with the length of the area of interest to be treated within the wellbore. In addition, the spacer pipe 46 may optionally be configured to telescopically extend, thereby allowing the upper 40 and lower 41 packing elements to further separate in response to a designated pressure applied between the packing elements 40, 41, as will be discussed below.

Connected to the spacer pipe 46 is a fluid placement port collar 500 of the present invention. In one aspect, the fluid placement port collar is a fracturing port collar 500 (or "frac port collar"). An enlarged view of the frac port collar 500 can also be seen in FIG. 1B, and extending into FIG. 1C. As shown in FIG. 1B, the frac port collar 500 is disposed intermediate the packing elements 40, 41. In the arrangement of FIG. 1, the top end of the frac port collar 500 is threadedly connected to the lower end of the spacer pipe 46, while the lower end of the frac port collar 500 is threadedly connected to the lower bottom sub 43.

Figure 3A:
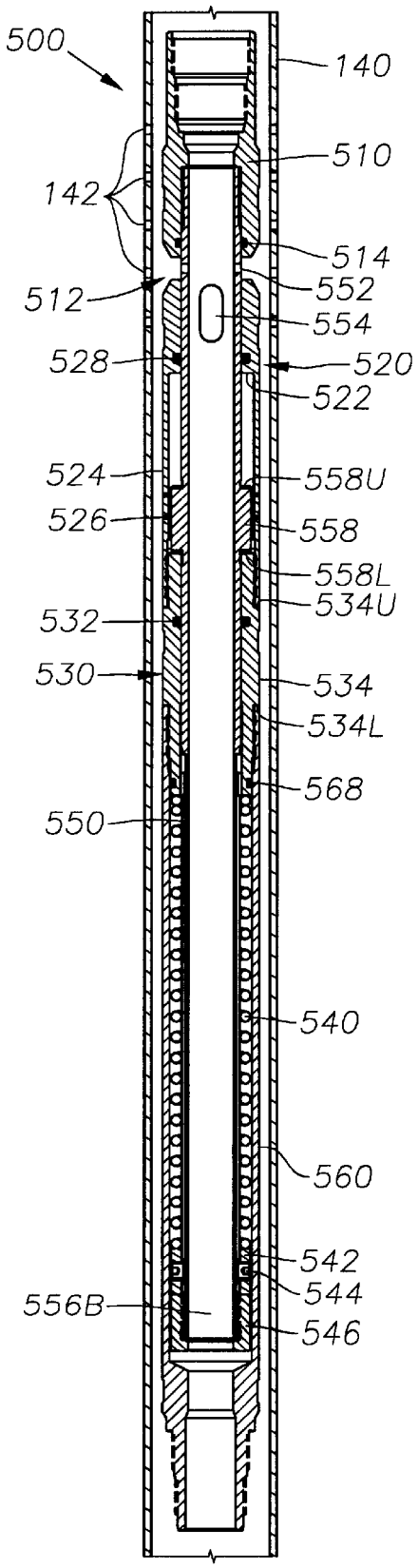
FIG. 3A presents a side, cross-sectional view of a fracturing port collar of the present invention, in its run-in position.

The details of the frac port collar 500 of FIGS. 1B–1C can be more fully seen in the cross-sectional depiction of FIG. 3A. FIG. 3A presents a frac port collar 500 of the present invention in its "run-in" position. As more fully seen in FIG. 3A, the frac port collar 500 first comprises a mandrel 550. The mandrel 550 defines a tubular body having a bore therethrough. The mandrel 550 has an inner surface and an outer surface. The mandrel 550 generally extends the length of the frac port collar 500.

The inner surface of the mandrel 550 is in fluid communication with the working string S. At the same time, the inner surface of the mandrel 550 is in fluid communication with the annular region formed between the pack-off system 10 and the surrounding casing string 140. To accomplish this, a first set of ports 552 is fabricated into the pack-off system 10. The first set of ports 552 may be placed in the spacer sub 46. In this arrangement, the ports 552 would be as shown at 47 in FIG. 1 of the '856 parent patent. However, it is preferred that the first set of ports 552 be placed into the mandrel 550 of the frac port collar 500. In the arrangement shown in FIG. 3A, ports 552, are seen disposed in the mandrel 550 for placing the inner surface and the outer surface of the mandrel 550 in fluid communication with each other.

The first ports 552 serve as packer actuation ports. The packer actuation ports 552 include at least one, and preferably four, ports 552 which are exposed to the annular region between the pack-off tool 10 and the surrounding perforated casing string 140. The packer actuation ports 552 are sized to permit an actuation fluid such as water or acidizing fluid to travel downward in the bottom of the mandrel 550, and to exit the mandrel 550. This occurs when circulation through the pack-off system 10 is sealed, as will be discussed below.

In accordance with the apparatus 500 of the present invention, a second set of ports 554 is also disposed in the wall of the mandrel 550. These second wall ports 554 may serve as frac ports 554. Again, at least one, but preferably four, frac ports 554 are provided. The frac ports 554 are initially substantially sealed by a surrounding tubular housing while the packing elements 40, 41 are being set. Preferably, the surrounding housing is an upper case, shown in FIG. 1B at 520. The surrounding upper case 520 is biased in a closed, or sealing position by a biasing member 540. In the arrangement of FIG. 3A, the biasing member 540 is a spring under compression. The surrounding upper case 520 prohibits fluids from flowing through the frac ports 554 while the packing elements 40, 41 are being set. However, upon injection of fluid under additional pressure through the packer actuation ports 552, the biasing spring 540 is further compressed, causing the upper case 520 to slide downwardly along the outer surface of the mandrel 550, thereby exposing the frac ports 554. The exposed frac ports 554 are seen in the actuated cross-sectional view of FIG. 3B.

In the preferred embodiment of the frac port collar 500 of the present invention, the frac port collar 500 is arranged to have a top sub 510. The top sub 510 is a generally tubular body positioned at the top 556T of the mandrel 550. A top end of the top sub 510 is configured as a box connector in order to threadedly connect with the optional spacer pipe 46. A bottom end of the top sub 510 is threadedly connected to a top end 556T of the mandrel 550. Thus, in the arrangement of the frac port collar 500 of FIG. 3A, the mandrel 550 is fixed to the top sub 510. A top sub seal 514 is disposed between the top sub 510 and the mandrel 550 in order to prevent both fluid and sand penetration during a formation fracturing operation.

The mandrel 550 includes an enlarged outer diameter portion 558. The enlarged outer diameter portion 558 has an upper shoulder 558U and a lower should 558L. The upper shoulder 558U serves as a stop member to the upper case 520 when it strokes downward.

The upper case 520 is positioned below the top sub 510. As noted, the upper case 520 likewise defines a generally tubular body. Thus, the mandrel 550 nests essentially concentrically within the top tubular sub 510 and the upper case 520. An upper case seal 528 is disposed between the upper case 520 and the mandrel 550, again, to restrict the flow of fluid and sand during the formation fracturing operation.

The top sub 510 and the upper case 520 are disposed around the mandrel 550 in such a manner as to leave an opening 512 between the top sub 510 and the upper case 520. In the preferred embodiment, the packer actuation ports 552 are affixed radially around the mandrel 550 at the position of the opening 512 between the top sub 510 and the upper case 520. However, the packer actuation ports 552 may be disposed elsewhere within the pack-off system 10, such as in an optional spacer sub 46. In this way, the packer actuation ports 552 place the inner surface of the mandrel 550 in constant fluid communication with the annular region between the collar 500 and the surrounding casing 140 (or formation).

The upper case 520 is configured to move downwardly along the mandrel 550 according to a designed stroke length. To accommodate this relative movement between the upper case 520 and the mandrel 550, the upper case 520 first includes an upper case shoulder 522. Above the shoulder 522 is an upper case extension member 524. The upper case extension member 524 includes optional pressure equalization ports 526. These ports 526 serve to permit any fluid trapped beneath the upper case extension member 524 to escape during movement of the upper case 520 downward.

As noted above, the mandrel 550 includes an enlarged outer diameter portion 558. The enlarged outer diameter portion 558 has an upper shoulder 558U, which serves as a stop member for the shoulder 522 of the upper case 520 when it strokes. The distance between the two shoulders 522, 558U defines the stroke length of the frac port collar 500. This stroke length is sufficient to expose the frac ports 554 when the lower case 520 strokes downward.

FIG. 3A presents the frac port collar 500 in its "run-in" position. In this position, it can be seen that the upper case 520 has not engaged the upper shoulder 558U of the mandrel 550. In this respect, the shoulder 522 of the upper case 520 has not been actuated in order to stroke downward and contact the upper shoulder 558U of the mandrel 558.

While the frac port collar 500 is in its "run-in" position, the lower shoulder 558L of the mandrel 550 butts against an upper end of a nipple 530. The nipple defines a tubular body residing circumferentially around a portion of the inner mandrel 550. A nipple seal 532 is disposed between the nipple 530 and the inner mandrel 550 in order to prohibit the invasion of fluid and sand during a formation fracturing operation.

The nipple 530 includes an enlarged outer diameter portion 534. The enlarged outer diameter portion has an upper nipple shoulder 534U at a top end, and a lower nipple shoulder 534L at a bottom end. In the arrangement of FIG. 3A, the upper case extension member 524 is threadedly connected at a lower end to a top end of the nipple 530 above the upper nipple shoulder 534U. In this way, stroking of the upper case 520 also causes the nipple 530 to move downward relative to the mandrel 550.

At the lower end of the fracturing port collar 10 is a lower case 560. The lower case 560 also defines a tubular member, and encompasses the bottom end 556B of the mandrel 550. The upper end of the lower case 560 is threadedly connected to a lower end of the nipple 530 below lower nipple shoulder 534L. In this regard, an upper end of the lower case 560 is positioned proximate to the lower nipple shoulder 534L during the manufacturing process. A lower case seal 568 (shown in FIG. 3A) is disposed between the lower case 560 and the lower end of the nipple 530.

Finally, a biasing member 540 is placed below the nipple 530 and around the inner mandrel 550. Preferably, the biasing member defines a powerful spring 540, as depicted in FIG. 3A. The spring 540 is held in compression, and urges the upper case 520 in its upward position so as to cover the frac ports 554.

FIG. 3A demonstrates several parts disposed below the spring 540. These include a stop ring 542, a set screw 544, and a spring back-up nut 546. The stop ring 542 is used to compress the spring 540 during the manufacturing operation. The set screw 544 is used to hold the spring 540 in its compressed state. The spring back-up nut 546 is used as a safety feature in the event the set screw 544 releases to ensure that the spring 540 does not unwind.

In order to actuate the frac port collar 500, a means is needed to shut off the flow of fluid through the pack-off system 10 and to force actuating fluid, e.g., water, through the packer actuation ports 552. Accordingly, a flow activated shut-off valve assembly 70 is provided. This assembly 70 is seen in the enlarged portion of the system 10 shown in FIG. 1D. The assembly 70 has a housing 71 with a top-to-bottom bore 77 therethrough. A nozzle 60 is threadedly connected to a lower end of the valve housing 71. The shut-off valve assembly 70 includes a piston 72 which is movable coaxially within the bore 77. The piston 72 has a piston body 73 which is disposed below the crossover sub 55. The piston 72 also includes a piston member 74 which defines a restriction within the bore 77. A piston orifice member 75 is disposed within the piston member 74 in order to define a through-opening 79. Finally, a locking ring 67 is provided in order to hold the piston orifice member 75 and the piston member 74 in place below the crossover sub 55.

The piston 72 is biased in its upward position. In this position, fluid is permitted to flow through the pack-off system 10 downward into the wellbore. In the arrangement seen in FIG. 1D, a spring 66 is used as a biasing member. The spring 66 has an upper end that abuts a lower end of the piston body 73. The spring 66 further has a lower end that abuts a top end of a nozzle 60.

The nozzle 60 defines a tubular member proximate to the bottom of the pack-off system 10. The nozzle 60 includes outlet ports 62 which initially place the orifice 79 of the piston 72 in fluid communication with the annular region between the pack-off system 10 and the surrounding casing 140. Inner ports 63 and 64 are used to create a flow path between the opening 79 in the piston 72 and the nozzle 60. The inner ports 63, 64 extend through a wall 61 of the nozzle 60.

As shown in FIGS. 1 and 1D, the nozzle 60 is in its open position. In this position, fluid is permitted to flow from the interior of the system 10; down through the orifice 79 of the piston orifice member 75; through a bore 78 of the piston member 74; into a bore 59 of the nozzle 60; out through the inner ports 63 into a space between the exterior of the wall 61 and an interior of the valve housing 71; in through the inner ports 64 and into a plug chamber 58 of the nozzle 60; and then out of the system 10 through the outlet ports 62.

In accordance with the straddle pack-off system 10 of the present invention, it is necessary to shut-off the flow of fluid through the valve assembly 70. As fluid under increasing pressure is injected into the wellbore, pressure builds above the piston 72 and the through-opening 79 until critical flow is reached. Ultimately, the pressure above the piston 72 acts to overcome the upward force of the spring 66 and to force the piston 72, including the piston member 74, downward.

A diverter plug 69 is placed within the bore 78 of the piston. As the piston member 74 is urged lower by fluid pressure, the piston member 74 surrounds the diverter plug 69. In so doing, a shut-off of inner port 63 is effectuated. This serves to cease the flow of fluid through inner port 64 and through outlet port 62.

O-rings or other sealing members are provided within the piston assembly 70 in order to provide a fluid seal. A seal 128 is provided for the interface between the piston body 73 and the valve housing 71. Seal 129 is placed between the nozzle wall 61 and the valve housing 71. Seal 130 is disposed between the nozzle wall 61 and the piston member 74. Finally, a seal 131 is placed at the inner face of the diverter plug 69 and the nozzle wall 61.

As disclosed in the '856 parent patent, other arrangements for shutting off flow through the lower end of the pack-off tool 10 may be used. These include the use of a dropped ball. Once the flow of fluid is shut off through the lower end of the pack-off tool 10, the lower end of the pack-off tool 10 becomes a piston end. In this respect, the pack-off tool 10 telescopes at least in accordance with the stroke length of the collar 500, thereby causing separation of the packing elements 40, 41.

In operation, the pack-off system 10 is run into the wellbore on the working string S, such as a string S of coiled tubing. The pack-off system 10 is positioned adjacent an area of interest, such as perforations 142 within a casing string 140. Once the pack-off system 10 has been located at the desired depth in the wellbore, fluid under pressure is pumped from the surface into the pack-off system 10. Actuating fluid is injected at a rate to achieve sufficient pressure within the system 10 to force the piston 72 and piston member 74 downward. As noted above, the piston member 74 will close off inner port 63, thereby closing off the fluid flow path through the nozzle 60 and the outlet ports 62. This, in turn, causes pressure to further increase. Because the pack-off system 10 is held at the top by the supporting working string S, the collet fingers 52U are released over the shoulders on the upper bottom sub 43. Likewise, the collet fingers 52L are forced to release from the shoulders on the lower bottom sub 43. This forces the various parts between the top packing element 40 and the bottom packing element 41 to telescope apart. This allows the setting sleeves 30 and 31 to move downwardly within the corresponding pack-off mandrels 20 and 21. The top setting sleeve 30 pushes down to set the top pack element 40; likewise, the bottom latch 51 is pulled down against the bottom packing element 41 so as to set the bottom packing element 41. The setting of the packing elements 40 and 41 within casing 140 is shown in FIG. 2.

After sufficient pressure has been applied to the pack-off system 10 through the bore of the mandrel 550 to set the packing elements 40, 41, fluid continues to be injected into the system 10 under pressure. Because the flow of fluid out of the bottom of the pack-off system 10 is closed off, fluid is forced to exit the system 10 through the packer actuation ports 552. From there fluid enters the annular region between the pack-off system 10 and the surrounding casing 140. The injected fluid is held in the annular region between the top packing element 40 and the bottom packing element 41. Fluid continues to be injected into the system 10 and through the packer actuation ports 552 until a greater second pressure level is reached. This causes the lower packing element 41 to slip within the inner diameter of the casing 140 and to further separate from the upper sealing element 40. This further separation causes the upper case 520 of the frac port collar 500 to move downward along the mandrel 550 in accordance with the stroke length of the tool 500. This, in turn, exposes the frac ports 554 to the annular region between the pack-off system 10 and the surrounding casing 140. A greater volume of fracturing fluid can then be injected into the wellbore so that formation fracturing operations can be further conducted.

In one arrangement of the straddle pack-off system 10 of the present invention, the packing elements 40, 41 are actuated with an application of wellbore pressure of approximately 175 pounds. Further telescoping of the pack-off system 10 in order to cause the lower packing element 41 to slip within the casing 140 and to expose the frac ports 554 is achieved at a second greater injection pressure of approximately 225 pounds. However, it is understood that the scope of the present invention allows for a pack-off system utilizing different injection pressures, so long as the opening of the frac ports 554 is accomplished through an injection pressure above the pressure required to set the packing elements.

Figure 3B:
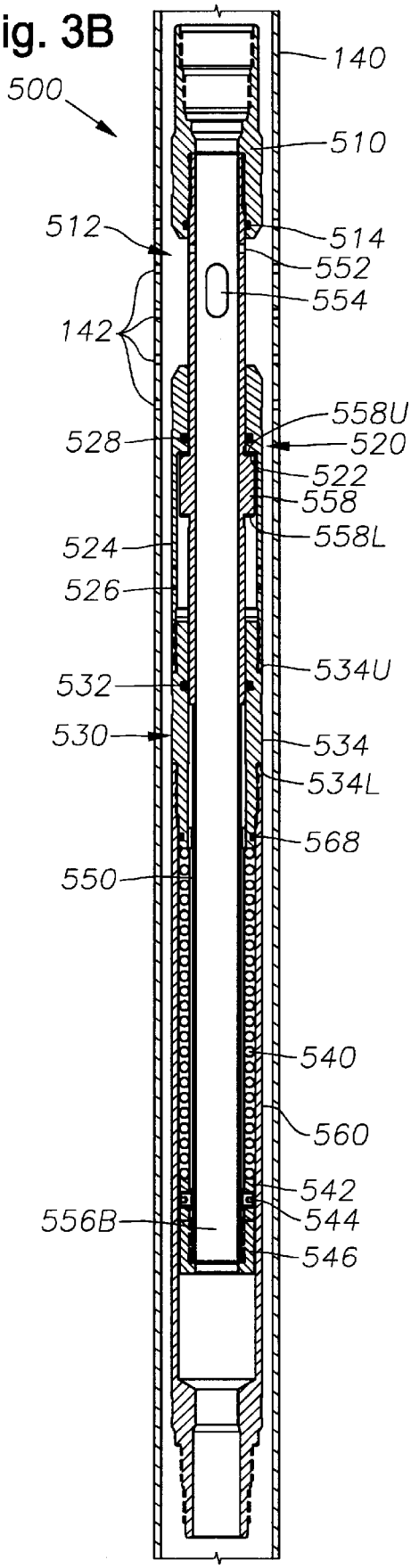
FIG. 3B presents the fracturing port collar of FIG. 3A, having been actuated so as to expose the frac ports.

The frac port collar 500 shown in FIGS. 3A and 3B may be used with any straddle pack-off system which permits the telescopic movement of a packing element. This would include any mechanical straddle tool system such as a tension packer/tandem packer system or an opposed cup system. However, the frac port collar is particularly advantageous for use with a straddle pack-off system which does not require pipe manipulation for setting. Such a pack-off system is useful in deep and highly deviated wellbores having inner diameter restrictions where standard mechanical systems will not work. Further, the collar 500 of the present invention may be used for any formation treatment operation, and is not limited to formation fracturing operations. It is further understood that the present invention includes any collar by which relative movement between a mandrel and a case is provided. In this respect, the scope of the present invention permits the mandrel to slidably move within the inner surface of the surrounding case, as opposed to the case sliding along the outer surface of the mandrel.

It is further understood that the frac port collar 500 disclosed herein may be used with any pack-off system described in the '856 parent application.

What is claimed is:

1. A fracturing port collar for use with a pack-off system within a wellbore, the fracturing port collar being disposed between an upper packing element and a lower packing element of the pack-off system, the fracturing port collar comprising:

a tubular inner mandrel having an inner surface and an outer surface, and defining a bore within the inner surface, the bore being placed in fluid communication with the outer surface of the mandrel by at least one packer actuation port;

at least one frac port for placing the inner surface and the outer surface of the mandrel in fluid communication with one another;

a tubular case disposed along a portion of the tubular inner mandrel, the tubular case being slidably movable relative to the mandrel between a first position and a second position, wherein the tubular case substantially seals the at least one frac port in its first position, and exposes the at least one frac port in its second position.

2. The fracturing port collar of claim 1, further comprising a biasing member for biasing the tubular case to substantially seal the at least one frac port.

3. The fracturing port collar of claim 2, wherein the biasing member is a spring.

4. The fracturing port collar of claim 2, wherein the upper packing element and the lower packing element are set, at least in part, through hydraulic pressure injected through the bore of the mandrel.

5. The fracturing port collar of claim 4, wherein the tubular case is disposed around the mandrel, and is slidably movable along the outer surface of the mandrel.

6. The fracturing port collar of claim 5, wherein the upper packing element and the lower packing element are set at a first pressure level; and wherein the fracturing port collar is configured to telescopically extend along a desired stroke length at a second greater pressure level in response to separation between the upper packing element and the lower packing element.

7. The fracturing port collar of claim 6, wherein the telescopic extension occurs between the tubular inner mandrel and the tubular case such that the tubular case is moved from its first position to its second position.

8. The fracturing port collar of claim 7, wherein the case slidably moves along the outer surface of the mandrel between its first and second positions.

9. The fracturing port collar of claim 1, wherein the fracturing port collar is run into the wellbore on a string of coiled tubing.

10. The fracturing port collar of claim 9, wherein the at least one packer actuation port is disposed within the mandrel of the frac port collar.

11. The fracturing port collar of claim 10, wherein the at least one packer actuation port is disposed within the mandrel immediately above the at least one frac port above the tubular case.

12. A fracturing port collar for use with a straddle pack-off system within a wellbore, the fracturing port collar being disposed between an upper packing element and a lower packing element of the straddle pack-off system, the fracturing port collar comprising:

an inner mandrel defining a tubular body, the mandrel having an inner surface defining a bore, and an outer surface;

at least one packer actuation port within the mandrel for placing the inner surface of the mandrel in fluid communication with the outer surface of the mandrel;

a first case defining a tubular body, the first case slidably moving along the outer surface of the mandrel;

at least one frac port in the mandrel, the frac port being substantially sealed by the first case at a first fluid pressure level between the upper packing element and the lower packing element, but being exposed so as to place the inner surface of the mandrel in fluid communication with the outer surface of the mandrel at a second fluid pressure level between the upper packing element and the lower packing element.

13. The fracturing port collar of claim 12, wherein the second fluid pressure level causes the upper packing element and the lower packing element to separate along a stroke length designed within the fracturing collar, thereby placing the inner surface of the mandrel in fluid communication with the outer surface of the mandrel.

14. The fracturing port collar of claim 13, wherein:

The second fluid pressure level is greater than the first fluid pressure level; and the frac port collar is configured to telescopically extend along the stroke length at the second greater fluid pressure level in response to the separation between the upper packing element and the lower packing element.

15. The fracturing port collar of claim 14, wherein the telescopic extension occurs between the tubular inner mandrel and the first case.

16. The fracturing port collar of claim 15, wherein the fracturing port collar is run into the wellbore on a string of coiled tubing.

17. The fracturing port collar of claim 16, wherein the inner surface of the mandrel is in fluid communication with the string of coiled tubing.

18. The fracturing port collar of claim 17, wherein the outer surface of the mandrel has an enlarged outer diameter portion which defines an upper shoulder and a lower shoulder.

19. The fracturing port collar of claim 18, further comprising:

a top sub, the top sub defining a tubular body disposed around the mandrel above the first case; and a second case, the second case defining a tubular body that is also slidably movable along the outer surface of the mandrel.

20. The fracturing port collar of claim 19, wherein the at least one packer actuation port is disposed in the mandrel between a bottom end of the top sub and an upper end of the first case.

21. The fracturing port collar of claim 20, wherein the first case comprises an upper body portion, a lower extension member, and a shoulder at a bottom end of the upper body portion.

22. The fracturing port collar of claim 21, wherein the stroke length is defined by the distance between the shoulder of the first case and the upper shoulder of the enlarged outer diameter portion of the mandrel.

23. The fracturing port collar of claim 22, further comprising a biasing member urging the first case and the second case in an upward position; and wherein the first case and the second case are moved downwardly along the outer surface of the mandrel in response to the second fluid pressure level.

24. The fracturing port collar of claim 23, further comprising a nipple, the nipple defining a tubular body disposed around the outer surface of the mandrel below the enlarged outer diameter portion of the mandrel, the nipple being threadedly connected to the lower extension member of the first case proximate to an upper end of the nipple, and being threadedly connected to the second case proximate to a lower end of the nipple.

25. The fracturing port collar of claim 24, further comprising a stop ring at a lower end of the mandrel; and wherein the biasing member defines a spring disposed around the outer surface of the mandrel held in compression between the stop ring and the nipple.

26. A fluid placement port collar for use within a wellbore, the fluid placement port collar being disposed in a tubular assembly between an upper packing element and a lower packing element of the tubular assembly, the fluid placement port collar comprising:

a tubular mandrel having a wall with at least one wall port through the wall; and a wall port closure member disposed along a portion of the tubular mandrel and being movable relative to the mandrel between a first position and a second position, wherein the port closure member substantially closes the at least one wall port in the first position and substantially opens the at least one wall port in the second position.

27. The fluid placement port collar of claim 26, wherein the wall port closure member is movable in response to changes in fluid flow rate.

28. The fluid placement port collar of claim 27, wherein the wall port closure member defines a tubular case disposed along a portion of the tubular mandrel, the tubular case being slidably movable relative to the mandrel between the first position and the second position, and wherein the tubular case substantially seals the at least one wall port in its first position, and exposes the at least one wall port in its second position.

29. The fluid placement port collar of claim 27, wherein the tubular mandrel has an inner surface and an outer surface, and wherein the tubular mandrel further comprises at least one packer actuation port for placing the inner surface of the tubular mandrel into constant fluid communication with the outer surface of the tubular mandrel.

30. The fluid placement port collar of claim 29, further comprising a biasing member for biasing the tubular case in its first closed position.

31. The fluid placement port collar of claim 30, wherein the biasing member is a spring.

32. The fluid placement port collar of claim 29, wherein the upper packing element and the lower packing element are set, at least in part, through hydraulic pressure injected through a bore of the mandrel.

33. The fluid placement port collar of claim 32, wherein the tubular case is disposed around the mandrel, and is slidably movable along the outer surface of the mandrel.

34. The fluid placement port collar of claim 33, wherein the upper packing element and the lower packing element are set at a first pressure level; and wherein the fluid placement port collar is configured to telescopically extend along a desired stroke length at a second greater pressure level in response to separation between the upper packing element and the lower packing element.

35. The fluid placement port collar of claim 34, wherein the telescopic extension occurs between the tubular mandrel and the tubular case such that the tubular case is moved from the first position to the second position.

36. The fluid placement port collar of claim 34, wherein the case slidably moves along the outer surface of the mandrel between its first and second positions.

37. The fluid placement port collar of claim 36, wherein the fluid placement port collar is run into the wellbore on a string of coiled tubing.

38. The fluid placement port collar of claim 37, wherein the at least one packer actuation port is disposed within the mandrel of the fluid placement port collar.

39. The fracturing port collar of claim 38, wherein the at least one packer actuation port is disposed within the mandrel immediately above the at least one wall port above the tubular case.

40. A method for injecting formation treatment fluid into an area of interest within a wellbore, the method comprising the steps of:

running a pack-off system into the wellbore, the pack-off system having a fracturing port collar disposed between an upper packing element and a lower packing element, the fracturing port collar comprising:

a tubular inner mandrel having an inner surface and an outer surface, and defining a bore within the inner surface, the bore being placed in fluid communication with the outer surface of the mandrel by at least one packer actuation port;

at least one frac port for placing the inner surface and the outer surface of the mandrel in fluid communication with one another; and a tubular case disposed around a portion of the tubular inner mandrel, the tubular case being slidably movable along the outer surface of the mandrel between a first position and a second position, wherein the tubular case substantially seals the at least one frac port in its first position, and exposes the at least one frac port in its second position;

positioning the pack-off system within the wellbore adjacent an area of interest;

injecting an actuating fluid into the pack-off system at a first fluid pressure level so as to set the upper and lower packing elements;

injecting an actuating fluid into the pack-off system at a second greater fluid pressure level so as to cause the case to slide along the outer surface of the mandrel from its first position to its second position; thereby exposing the at least one frac port; and injecting a formation treating fluid into the pack-off system through the exposed at least one frac port.

41. The method of claim 40, wherein the inner surface of the mandrel is in fluid communication with a working string.

42. The method of claim 41, further comprising a biasing member for biasing the tubular case to substantially seal the at least one frac port.

43. The method of claim 42, wherein the biasing member is a spring.

44. The method of claim 42, wherein the fracturing port collar is configured to telescopically extend along a desired stroke length at the second greater pressure level in response to separation between the upper packing element and the lower packing element.

45. The method of claim 44, wherein the telescopic extension occurs between the tubular inner mandrel and the tubular case.

46. The method of claim 45, wherein the telescopic extension occurs when the tubular case moves from its first position to its second position.

47. The method of claim 42, wherein the fracturing port collar is run into the wellbore on a string of coiled tubing.

48. The method of claim 46, wherein the at least one packer actuation port is disposed within the mandrel of the frac port collar.

49. The method of claim 48, wherein the at least one packer actuation port is disposed within the mandrel proximate to the at least one frac port collar.

50. A method for placing fluid into an area of interest within a wellbore, the method comprising the steps of:

running a pack-off system into the wellbore, the pack-off system having a port collar disposed between an upper packing element and a lower packing element, the port collar comprising:

a tubular mandrel having a wall with at least one wall port through the wall;

a wall port closure member disposed along a portion of the tubular mandrel, and being slidably movable relative to the mandrel between a first position and a second position, wherein the wall port closure member substantially closes the at least one wall port in the first position, and substantially opens the at least one wall port in the second position;

positioning the pack-off system within the wellbore adjacent an area of interest;

flowing fluid into the pack-off system to set the upper and lower packing elements and to move the wall port closure member from the first position to the second position thereby substantially opening the at least one wall port; and placing a fluid into the pack-off system and through the opened at least one wall port.

51. The method of claim 50, wherein:

the tubular mandrel has an inner surface and an outer surface;

the tubular mandrel further comprises at least one packer actuation port for placing the inner surface of the tubular mandrel in fluid communication with the outer surface of the tubular mandrel, the at least one packer actuation port being disposed immediately above the at least one wall port; and the tubular mandrel is in fluid communication with a working string.

52. The method of claim 51, wherein the wall port closure member defines a tubular case disposed along a portion of the tubular mandrel, the tubular case being slidably movable relative to the mandrel between the first position and the second position, and wherein the tubular case substantially seals the at least one wall port in the first position, and substantially opens the at least one wall port in the second position.

53. The method of claim 52, wherein the port collar further comprises a biasing member for biasing the tubular case to substantially seal the at least one frac port, the biasing member defining a spring.

54. The method of claim 53, wherein the port collar is configured to telescopically extend along a desired stroke length at a second greater pressure level in response to separation between the upper packing element and the lower packing element.

55. The method of claim 54, wherein the telescopic extension occurs between the tubular mandrel and the tubular case when the tubular case moves from the first position to the second position.

56. The method of claim 55, wherein the working string is a string of coiled tubing.

* * * * *